US005918612A

United States Patent [19]

Hughes

[11] Patent Number: 5,918,612

[45] Date of Patent: Jul. 6, 1999

[54] HANDS-FREE UMBRELLA HOLDER

[76] Inventor: Frank Hughes, 177 South Highland Rd., Springfield, Pa. 19064

[21] Appl. No.: 08/917,260

[22] Filed: Aug. 25, 1997

[51] Int. Cl.[6] ..... A45B 11/02

[52] U.S. Cl. ..... 135/16; 224/188; 224/186

[58] Field of Search ..... 135/16, 20.1, 19; 224/186, 187, 188–190, 915, 642, 644, 251, 907, 514, 515, 517, 208, 262, 200, 242, 247

[56] References Cited

U.S. PATENT DOCUMENTS

| | | | |
|---|---|---|---|
| 191,782 | 6/1877 | Smith, Sr. . | |
| 853,397 | 5/1907 | Butler . | |
| 1,657,263 | 1/1928 | Lauby . | |
| 2,496,769 | 2/1950 | Battle | 135/20.1 X |
| 3,204,650 | 9/1965 | Shinew | 135/20.1 X |
| 3,700,149 | 10/1972 | Grogan . | |
| 4,537,339 | 8/1985 | Pearson . | |
| 5,323,941 | 6/1994 | Sobolev . | |
| 5,353,977 | 10/1994 | Schiro, Jr. et al. . | |
| 5,513,786 | 5/1996 | Drane . | |
| 5,620,119 | 4/1997 | Keller | 135/20.1 X |

FOREIGN PATENT DOCUMENTS

| | | |
|---|---|---|
| 1069295 | 12/1952 | France . |

*Primary Examiner*—Carl D. Friedman
*Attorney, Agent, or Firm*—Robert S. Lipton, Esq.; Lipton, Weinberger & Husick

[57] ABSTRACT

An umbrella holder is provided which permits the user to be protected by an umbrella while permitting the user's hands to remain free. The holder includes a waist belt and shoulder strap. Means for securing the umbrella handle to the waist belt and the umbrella shaft to the shoulder strap are provided. The belt and strap are adjustable and permit the umbrella shaft to be secured to the user's chest without impinging on a breast of the user and permitting the belt to be raised or lowered with respect to the user's waist thus enabling umbrellas having different shaft lengths to be accommodated as well as users having different waist to shoulder dimensions.

2 Claims, 4 Drawing Sheets

HANDS-FREE UMBRELLA HOLDER

BACKGROUND OF THE INVENTION

1. Field of the Invention

The present invention relates generally to an apparatus which secures an umbrella to the user's body without requiring the use of the user's hands. More specifically, this invention relates to devices for this purpose which utilize a waist belt and a shoulder strap.

As is well known, umbrellas are used primarily for protecting the user from rain and to a lesser extent to protect the user from the rays of the sun. While the user of an umbrella is holding the umbrella with a hand, that hand is not available for other uses.

Common examples of users of umbrellas being frustrated due to their inability to have use of both of their hands while holding an umbrella include, but are by no means limited to the following few situations. Shoppers walking from a store in the rain have difficulty protecting themselves from rain by holding an umbrella and carrying packages at the same time. A parent attempting to protect herself or himself from the rain with an umbrella while at a sports event has difficulty attending to an infant, holding the umbrella and the hand of another child or carrying a package(s).

2. Description of the Prior Art

The desirability of being able to use an umbrella while keeping both of one's hands free has long been recognized in the prior art.

U.S. Pat. No. 1,657,263 issued Jan. 8, 1927, to Lauby teaches an umbrella holder having a waist belt and a shoulder strap and is well known in the prior art. Lauby teaches a belt which encompasses the user's waist and a shoulder strap which has one end connected to the belt behind the user and its opposite end connected to the belt in front of the user. An umbrella handle is secured to the belt in front of the user and the umbrella shaft is vertically secured, to one side of the user's body, to the upper portion of the shoulder strap. The umbrella is thus secured to the user's body leaving the user's hands and arms available for other uses.

U.S. Pat. No. 4,537,339 issued Aug. 27, 1985, to Pearson also teaches a waist belt and shoulder strap device for use in holding an umbrella. The Pearson device, like the Lauby device, secures both the umbrella handle and the umbrella shaft on the same side of the user. This maintains the umbrella shaft in a substantially vertical position.

The prior art also teaches other umbrella holders which use a tube or other rigid members which are affixed to the shoulder strap of a belt and strap combination. The umbrella, rather than being secured directly to the belt and shoulder strap, is simply inserted into the tube or secured to the rigid members. The use of such tubes or other rigid members eliminates the adjustability of the umbrella holder. Umbrella holders of this type are shown in U.S. Pat. No. 3,700,149 issued Oct. 24, 1972, to Grogan and in U.S. Pat. No. 5,513,786 issued May 7, 1996, to Drane.

SUMMARY OF THE INVENTION

The prior art devices for holding umbrellas, of the type having a waist belt and a shoulder strap, have not accommodated certain users. In general they have been able to accommodate only users whose waist to shoulder height fell within a narrow range.

More particularly they have not been able conveniently to accommodate women in general and women with large breasts in particular. The prior art devices of the type having a belt and shoulder strap construction have supported umbrellas in a substantially vertical position. In order not to have the umbrella shaft in the user's face, the umbrella is vertically positioned on the user's left or right side. This causes the umbrella shaft to be forced against the female user's breast. If the umbrella is properly secured during use, it impinges on the user's breast, causing discomfort. The degree of discomfort increases with the increasing size of the user's breasts. The level of discomfort may be decreased by loosening the shoulder strap. However, this frequently permits the umbrella to move to such an extent that the user is not adequately protected from the rain.

These problems are solved by an umbrella holding device that secures an umbrella to a user in a hands-free manner and that is adaptable to the user's anatomy. The device includes an adjustable waist belt and an adjustable shoulder strap. The length of both the waist belt and the shoulder strap can be varied. Means for securing an umbrella handle to the waist belt and means for securing the umbrella shaft to the shoulder strap are provided. The shoulder strap is connected to the waist belt in such a manner that it passes between the users breasts. The user positions the umbrella shaft so that it is vertically secured to the user's chest without impinging a breast. The means for securing the umbrella shaft to the shoulder strap permits the user to vary the position of the shaft on the strap.

By adjusting the length of the shoulder strap and appropriately positioning the vertical position of the waist belt above or below the waist, users having different waist-to-shoulder dimensions may be accommodated. The same type of adjustment may be used to accommodate umbrellas having different shaft lengths. By appropriately rotating the waist belt with respect to the user's body and securing the umbrella in the appropriate position to the shoulder strap, the umbrella shaft can be vertically secured to the front of the user's body.

Accordingly, it is an object of the present invention to provide an umbrella holding device for securing an umbrella to the chest of the user which can accommodate umbrellas having shafts of different lengths.

It is another object of the present invention to provide an umbrella holding device which can accommodate users having different waist-to-shoulder dimensions.

It is another object of the present invention to provide an umbrella holding device which will enable a female user thereof to secure an umbrella to her chest without its impinging on a breast.

It is another object of the present invention to provide an umbrella holding device which achieves the foregoing objects by having an adjustable waist belt and an adjustable shoulder strap.

DETAILED DESCRIPTION OF THE EMBODIMENT

Figure 1:
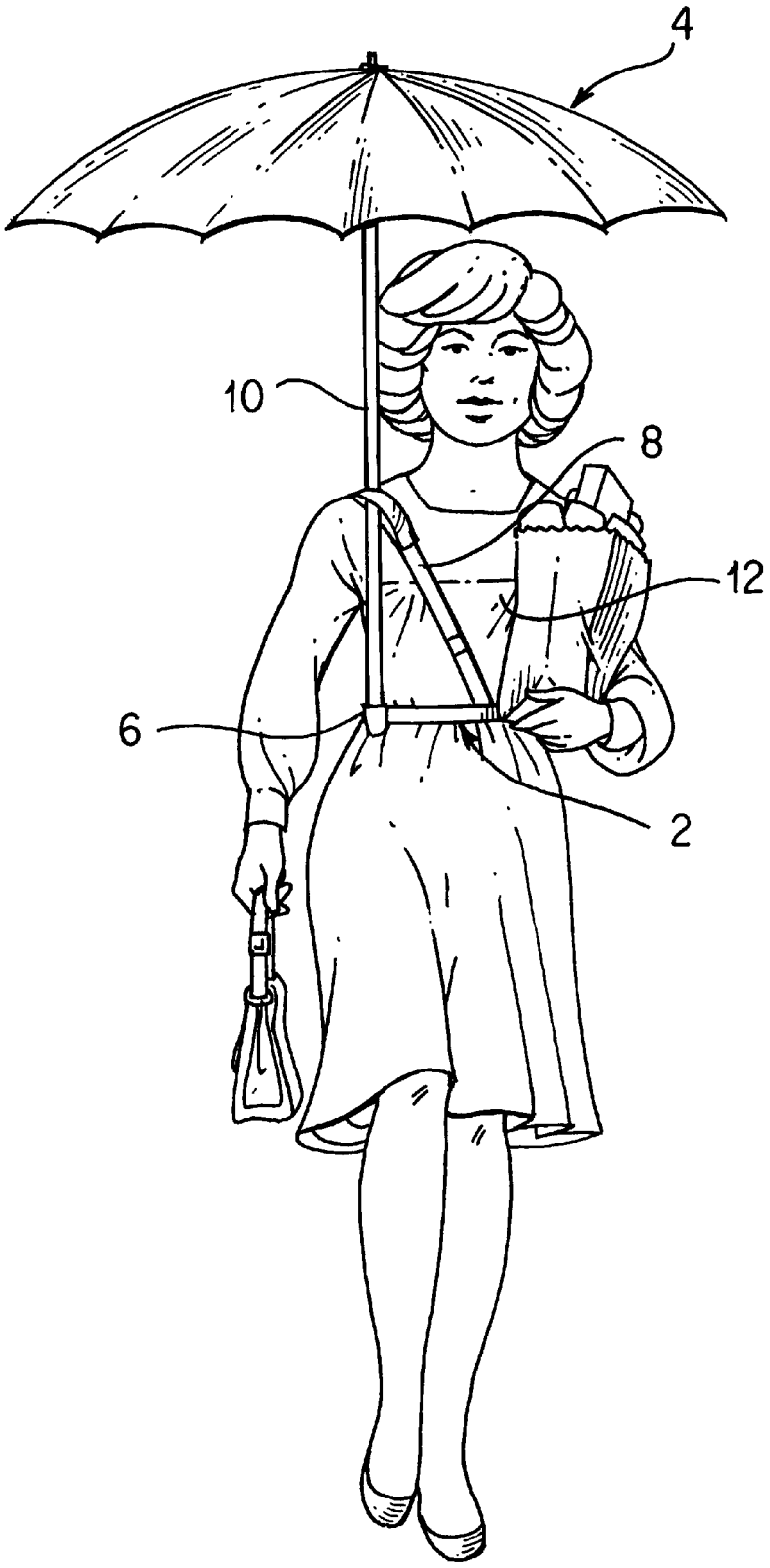
FIG. 1 is a perspective view of the invention securing an umbrella to a user.

The umbrella holder 2 of the present invention is shown in FIG. 1 securing umbrella 4 to a female user. The umbrella holder 2 has a belt 6 secured about the user's waist. A strap 8 passes over the user's shoulder and is connected to the belt 6 at its opposite ends in front of and behind the user. The umbrella shaft 10 is secured to shoulder strap 8 and to the waist belt 6 so that it does not impinge on the user's breasts 12. The umbrella is thus secured to the user by the umbrella holder while at the same time permitting both of the user's hands to be available for other uses.

Figure 2:
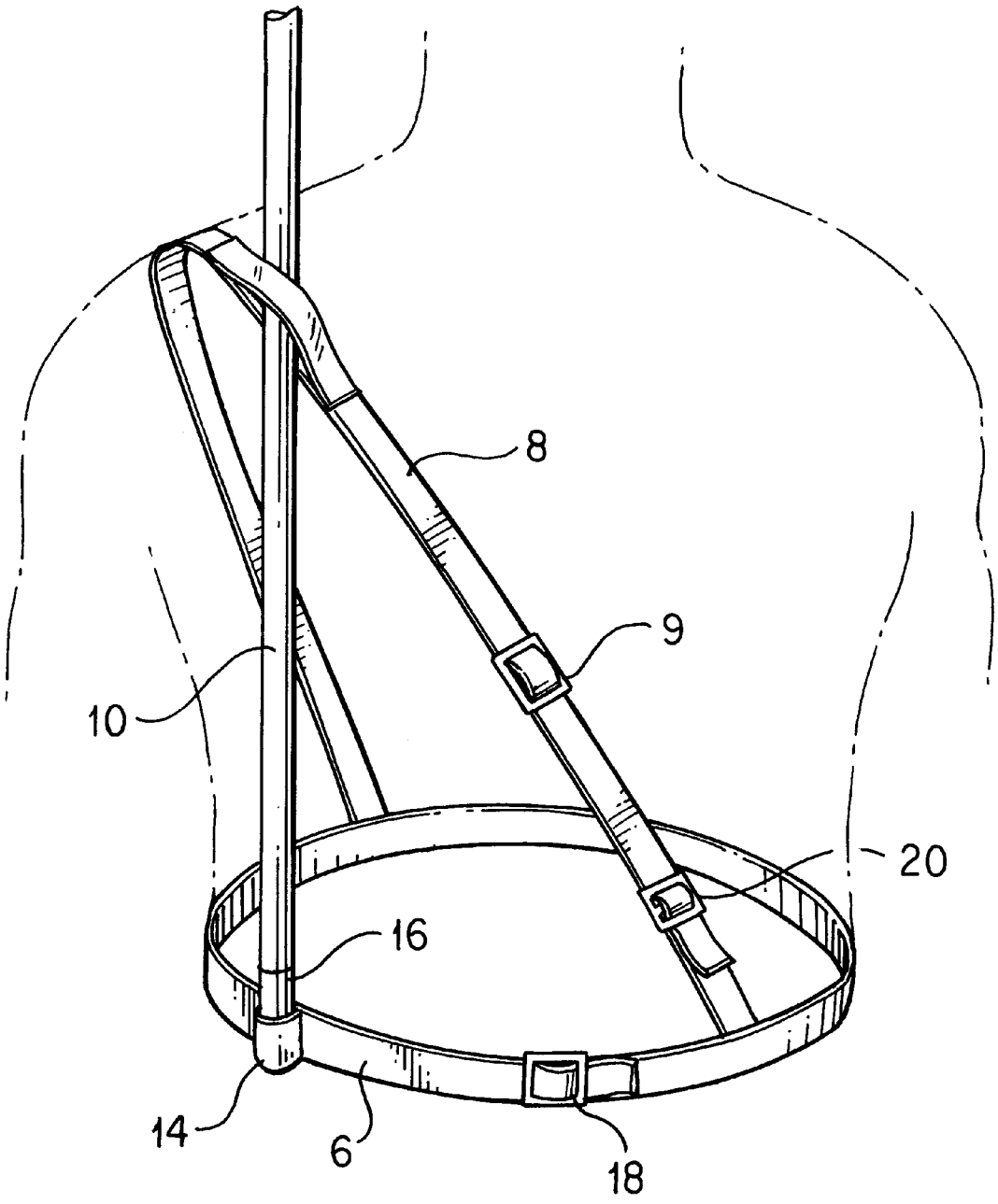
FIG. 2 is a perspective view of the invention

Reference will now be made to FIG. 2 where a pocket 14 is shown connected to the belt 6 for holding an umbrella handle 16 which is connected to the end of the umbrella shaft 10. The pocket 14 may be secured to the belt 6 by stitching it with thread or by any other suitable means as will be apparent to one skilled in the art. The configuration of the pocket may be altered to receive a traditional curved or hook-shaped umbrella handle.

The belt 6 has a buckle 18 which enables the belt 6 to be conveniently placed about the user's waist. The buckle, in the preferred embodiment, is of the type which when properly connected to the belt 6 enables its length to be altered. This enables it to be fitted to accommodate the user. If desired, the mechanism for adjusting the length of the belt 6 may not include the belt buckle 18. Similarly, the shoulder strap 8 also includes a buckle 20. Strap 8 also includes adjustment means 9 for enabling the length of the strap to be increased or decreased; alternatively, the buckle 20 may also include adjustment means.

Figure 3A:
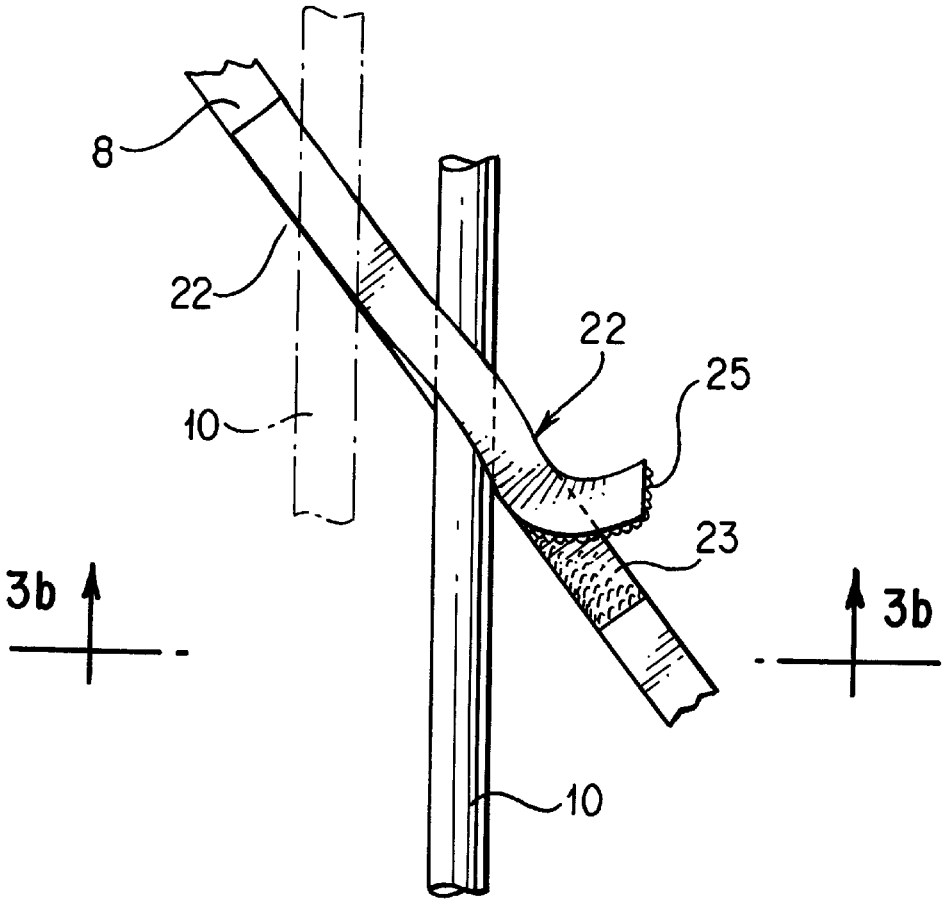
FIGS. 3*a* and 3*b* show a view of the means for securing the umbrella shaft to the shoulder strap which is shown in FIG. 2.
Figure 3B:
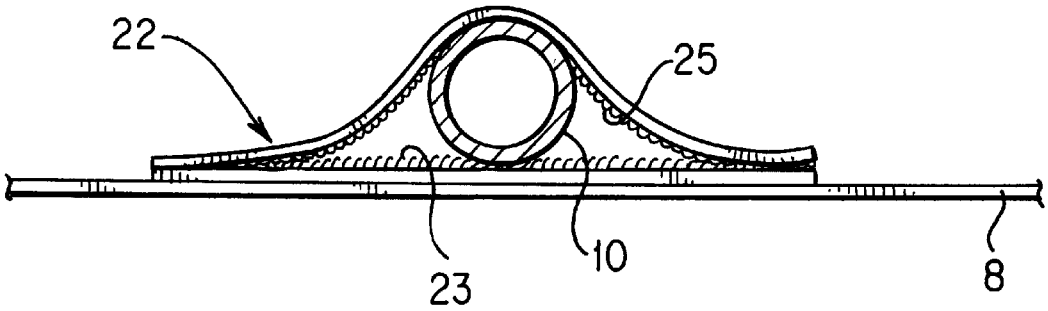

As shown in FIGS. 3*a* and 3*b*, a strip 22 of hooks 23 and eyes 25 are connected to shoulder strap 8. The strip of hooks and eyes are used to easily secure the umbrella shaft 10 to shoulder strap 8 within a range of positions along the length of shoulder strap 8. The range is defined by the length of the hook and eye strip 22. The umbrella shaft 10 is shown in phantom secured to strap 8 in an alternate position. The strip 22 of hooks 23 and eyes 25 may be secured to strap 8 by any suitable means but are stitched to it in the preferred embodiment.

Figure 4A:
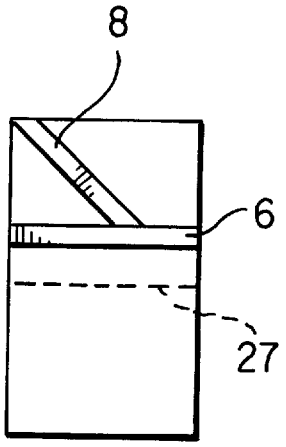
FIGS. 4*a*–4*c* schematically show the invention in different positions on a user.
Figure 4B:
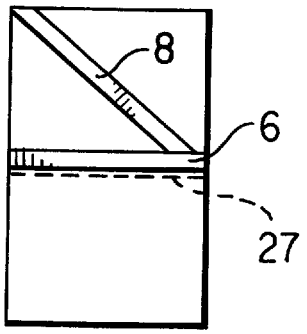
Figure 4C:
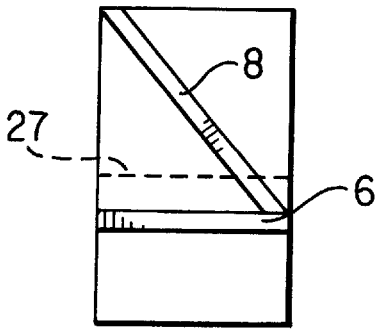

In use, umbrella holder 2 may be adjusted so that it can hold umbrellas having shafts of different lengths and to position the umbrella shaft 10 so that it is comfortably secured to the user's body. FIGS. 4*a*–4*c* schematically depict belt 6, respectively, at the user's waist 27, above the waist and below the waist to accommodate umbrellas having shafts of different lengths. An umbrella having a very short shaft may, depending on the relative dimensions of the particular user to the dimensions of the umbrella, require that shoulder strap 8 be shortened so that belt 6 is positioned above the user's waist. Conversely, a long umbrella shaft may require that strap 8 be lengthened so that belt 6 is positioned below the user's waist; of course, this also depends on the user's applicable dimensions relative to the dimensions of the umbrella.

Women may adjust umbrella holder 2 so that umbrella shaft 10 does not impinge on a breast by adjusting the position of shaft 10 within the range of positions afforded by hook and eye strip 22. The positioning of shaft 10 between the user's breasts may also be adjusted by appropriately positioning belt 6 and thus repositioning strap 8 by rotating the belt 6 with respect to the user's waist.

Although the present invention has been shown and described with respect to this particular embodiment, it should be understood by those skilled in the art that various changes may be made without departing from the spirit and scope of the invention.

What is claimed is:

1. An umbrella holder to be worn by a user for holding an open umbrella above the user which comprises:

a waist belt having means for adjusting its length adapted to encompass the waist of a user;

a shoulder strap having means for adjusting its length connected at its opposite ends to said waist belt for disposition diagonally across the chest of the user and between the user's breasts, over a shoulder of the user and diagonally across the back of the user;

means for holding an umbrella handle connected to said belt; and means for releasably securing an umbrella shaft to said shoulder strap, said securing means positioning the umbrella shaft proximate to the user's side without impinging upon the user's said strap adjusting means being adapted to vary the position of the umbrella shaft with respect to said strap along a portion of the length of said strap and to raise or lower said belt with respect to the user's waist, thus accommodating users having different waist to shoulder dimensions and umbrellas having shafts of different lengths.

2. The umbrella holder of claim 1 wherein said means for securing said umbrella shaft to said strap is a strip of hooks and eyes connected to said strap.

* * * * *

UNITED STATES PATENT AND TRADEMARK OFFICE

CERTIFICATE OF CORRECTION

PATENT NO. : 5,918,612

DATED : July 6, 1999

INVENTOR(S) : F. Hughes

It is certified that error appears in the above-identified patent and that said Letters Patent is hereby corrected as shown below:

Please amend claim 1 as follows:

In column 4, line 36, after the word 'user's' insert -- breasts and --.

Signed and Sealed this

Twenty-eighth Day of December, 1999

*Attest:*

Q. TODD DICKINSON

*Attesting Officer*

*Acting Commissioner of Patents and Trademarks*